US011518959B2

(12) United States Patent
Doering et al.

(10) Patent No.: US 11,518,959 B2
(45) Date of Patent: Dec. 6, 2022

(54) CORROSION PROTECTION FOR GLASSWARE IN A DISHWASHER

(71) Applicant: Henkel AG & Co. KGaA, Duesseldorf (DE)

(72) Inventors: Thomas Doering, Dormagen (DE); Thomas Weber, Weimar (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 84 days.

(21) Appl. No.: 17/074,064

(22) Filed: Oct. 19, 2020

(65) Prior Publication Data

US 2021/0032571 A1 Feb. 4, 2021

Related U.S. Application Data

(63) Continuation of application No. PCT/EP2019/058237, filed on Apr. 2, 2019.

(30) Foreign Application Priority Data

Apr. 19, 2018 (DE) ..... 102018205971.3

(51) Int. Cl.

| | |
|---|---|
| ***C11D 3/37*** | (2006.01) |
| ***C11D 3/00*** | (2006.01) |
| ***C11D 11/00*** | (2006.01) |
| ***C11D 17/00*** | (2006.01) |

(52) U.S. Cl.
CPC ..... *C11D 3/0073* (2013.01); *C11D 11/0035* (2013.01); *C11D 17/003* (2013.01)

(58) Field of Classification Search
CPC ..... C11D 11/0023; C11D 3/0073
USPC ..... 510/220
See application file for complete search history.

(56) References Cited

U.S. PATENT DOCUMENTS

| | | | | |
|---|---|---|---|---|
| 6,622,736 | B1 | 9/2003 | Hahn | |
| 2003/0158064 | A1* | 8/2003 | Kessler | C11D 3/3757 510/223 |
| 2005/0075258 | A1 | 4/2005 | Kessler et al. | |
| 2006/0199750 | A1* | 9/2006 | Berger | C11D 3/362 510/220 |
| 2010/0016203 | A1* | 1/2010 | Warkotsch | C11D 3/364 528/25 |
| 2013/0102515 | A1* | 4/2013 | Hueffer | C11D 3/2075 510/109 |

FOREIGN PATENT DOCUMENTS

| | | | |
|---|---|---|---|
| DE | 10225115 | A1 | 12/2003 |
| WO | 2004061068 | A1 | 7/2004 |
| WO | 2010065482 | A1 | 6/2010 |

OTHER PUBLICATIONS

PCT International Search Report PCT/EP2019/058237 Completed: Jul. 1, 2019 dated Jul. 8, 2019 2 pages.

* cited by examiner

*Primary Examiner* — Gregory E Webb
(74) *Attorney, Agent, or Firm* — Bojuan Deng

(57) ABSTRACT

A gel which is based on polysaccharide and which includes glass protection additives selected from zinc salts, polyvinyl amide, polyvinyl amine, or combinations thereof. The invention additionally relates to the use of the gel for the corrosion protection of glassware during cleaning and/or rinsing processes, in particular in a dishwasher, and to a method for preventing the corrosion of glassware during cleaning and/or rinsing processes, in particular in a dishwasher.

20 Claims, No Drawings

CORROSION PROTECTION FOR GLASSWARE IN A DISHWASHER

FIELD OF THE INVENTION

The present invention relates to a polysaccharide-based gel which comprises glass protection additives selected from zinc salts, polyvinylamide, polyvinylamine or combinations thereof. The present invention also relates to the use of this gel for the corrosion protection of glassware during cleaning and/or rinsing processes, in particular in a dishwasher, and a method for inhibiting the corrosion of glassware during cleaning and/or rinsing processes, in particular in a dishwasher.

BACKGROUND OF THE INVENTION

The corrosion of glassware during cleaning and/or rinsing processes of a dishwasher is a problem which has been known for a long time. Glassware is subject to varying degrees of corrosion during repeated rinsing processes in a dishwasher. This leads to progressive hydrolysis of the silicate network after the discharge of minerals. This can then lead to the formation of visible cloudiness and streaks in the glass caused by deposition.

Various approaches for overcoming the problems described are known from the prior art.

For example, EP 1 141 190 A1 describes the use of water-soluble glass as corrosion protection for glassware. However, the production of water-soluble glass is both time- and energy-consuming, since this has to be carried out at process temperatures of approximately 850° C.

BRIEF SUMMARY OF THE INVENTION

The problem addressed by the present invention was therefore that of providing a system which can prevent or slow down the corrosion problems described above and is also simple to produce.

The inventors of the present invention have found in this respect that the problem can be solved by a polysaccharide-based gel which comprises glass protection additives selected from zinc salts, polyvinylamide, polyvinylamine or combinations thereof.

In a first aspect, the present invention therefore relates to a gel which is suitable for the corrosion protection of glassware and which comprises or consists of

- at least one polysaccharide polymer;
- at least one glass protection additive selected from zinc salts, polyvinylamine, polyvinylamide or mixtures thereof;
- optionally at least one solvent; and
- optionally at least one additive.

In a further aspect, the invention also relates to the use of the gel according to the invention for the corrosion protection of glassware, in particular during cleaning and/or rinsing processes in a dishwasher.

Finally, the invention also relates to methods for inhibiting the corrosion of glassware, in particular in cleaning and/or rinsing processes, comprising the steps of:

i) bringing the glassware into contact with the gel according to the invention, wherein the gel has been dissolved in water, in particular in a dishwasher;

ii) optionally carrying out a cleaning or rinsing step.

According to the present invention, the weight-average molecular weight can be determined by means of gel permeation chromatography using polystyrene standards.

Unless otherwise indicated, all amounts indicated in connection with the constituents of the gel described herein refer to wt. %, in each case based on the total weight of the gel. Moreover, amounts that relate to at least one constituent always relate to the total amount of this type of constituent contained in the gel, unless explicitly indicated otherwise. This means that specified amounts of this type, for example in connection with "at least one additive," refer to the total amount of additive contained in the gel.

"At least one," as used herein, refers to one or more, for example 1, 2, 3, 4, 5, 6, 7, 8, 9 or more. In connection with constituents of the compositions described herein, this information does not refer to the absolute amount of molecules, but to the type of the constituent. "At least one additive" therefore signifies, for example, one or more different additives, i.e. one or more different types of additives. Together with stated quantities, the stated quantities refer to the total amount of the correspondingly designated type of constituent, as defined above.

"Substantially free," as used herein, means that the particular compound is contained in the relevant component or composition in less than 0.01 wt. %, preferably 0.001 wt. %, more preferably 0.0001 wt. %, and most preferably not at all. In particular, it also means that the relevant compound was not intentionally added.

The term "gels" or "solid gels," as used interchangeably herein, refers to preparations which, under standard conditions (25° C.; 1013 mbar), require a force of at least 0.03 mN to be able to penetrate 5 mm deep into the relevant product matrix of a 30° cone made of stainless steel (measured using the Texture Analyzer TA.XT plus).

The polysaccharide-based gel is in this case in particular a gel based on a cationic polysaccharide, in particular selected from the group of cationic cellulose polymers and/or cationic guar derivatives.

DETAILED DESCRIPTION OF THE INVENTION

In various embodiments, the at least one polysaccharide polymer is contained in 0.1 wt. % to 3 wt. %, preferably 0.2 wt. % to 1.5 wt. %, based on the total weight of the gel.

The gels preferably contain, as cationic polysaccharide polymer(s), based on the weight of the gel, 0.1 to 3 wt. %, preferably 0.15 to 2 wt. %, more preferably 0.1 to 1.5 wt. %, and in particular 0.15 to 0.8 wt. %, of at least one polymer from the group of cationic cellulose polymers and/or cationic guar derivatives.

Cationic cellulose compounds within the meaning of the invention are those which carry more than one permanent cationic charge in at least one side chain. Cellulose is constructed from beta-1,4-glycosidically linked D-glucopyranose units and forms unbranched, water-insoluble chains. A "side chain" of a cellulose is defined as chemical substituents which bond to the cellulose backbone and are not part of the native cellulose, since they have been introduced subsequently, for example by chemical synthesis.

Quaternized cellulose polymers originating from hydroxy (C2-C4)alkyl celluloses, particularly preferably from hydroxyethyl celluloses, are preferred.

Polymers of this kind are known to a person skilled in the art and are commercially available from various companies. The cationic cellulose derivatives known by the INCI names polyquaternium-4, polyquaternium-10, polyquaternium-24, polyquaternium-67 and/or polyquaternium-72 are particularly preferred. Polyquaternium-10, polyquaternium-24 and/ or polyquaternium-67 are very particularly preferred, with polyquaternium-10 being particularly preferred.

Preferred gels according to the invention contain, as cationic polysaccharide polymer(s), based on the weight of the gel, 0.01 to 3 wt. %, preferably 0.05 to 2 wt. %, more preferably 0.1 to 1.5 wt. %, and in particular 0.15 to 0.8 wt. %, of at least one polymer from the group of polyquaternium-4, polyquaternium-10, polyquaternium-24, polyquaternium-67 and/or polyquaternium-72.

Particularly preferred gels according to the invention contain, as cationic polysaccharide polymer(s), based on the weight of the gel, 0.01 to 3 wt. %, preferably 0.05 to 2 wt. %, more preferably 0.1 to 1.5 wt. %, and in particular 0.15 to 0.8 wt. %, of polyquaternium-10.

Suitable cationic guar derivatives within the meaning of the invention are cationic hydroxyalkyl guar derivatives, preferably cationic hydroxyethyl trimethylammonium guar and/or cationic hydroxypropyl trimethylammonium guar having weight-average molecular weights between 100,000 and 2,000,000 g/mol.

The cationic guar polymers known by the INCI name guar hydroxypropyltrimonium chloride having a weight-average molecular weight of between 200,000 and 1,600,000 g/mol are particularly preferred. The cationic charge density of these guar polymers is preferably at least 0.4 meq/g, preferably at least 0.5 meq/g, and in particular at least 0.6 meq/g. The determination can in this case be carried out by means of titration, for example. Their nitrogen content is preferably in a range of from 1.1 to 1.8 wt. % (based on their total weight).

Cationic guar derivatives known by the INCI name guar hydroxypropyltrimonium chloride are known to a person skilled in the art and are obtainable from various providers under the trade names Cosmedia® Guar, N-Hance® and/or Jaguar®, for example.

Particularly preferred gels according to the invention contain, as cationic polysaccharide polymer(s), based on the weight of the gel, 0.01 to 3 wt. %, preferably 0.05 to 2 wt. %, more preferably 0.1 to 1.5 wt. %, and in particular 0.15 to 0.8 wt. %, of guar hydroxypropyltrimonium chloride.

The gel of the present invention also contains at least one glass protection additive selected from zinc salts, polyvinylamine, polyvinylamide or mixtures thereof.

In various embodiments, the at least one glass protection additive is contained in 0.1 to 15.0 wt. %, preferably 2.0 to 10.0 wt. %, based on the total weight of the gel.

Preferred zinc salts are zinc acetate, zinc chloride, zinc oxide, zinc sulfide, zinc stearate, zinc carbonate and zinc ricinoleate, with zinc chloride, zinc acetate and zinc ricinoleate being particularly preferred.

Polyvinylamine compounds within the meaning of the invention are polyvinylamine polymers. Polyvinylamide compounds within the meaning of the invention are polyvinylamide polymers.

The polyvinylamine-containing and/or polyvinylamide-containing polymers which are preferably to be used according to the invention can be prepared by means of radical polymerization of N-vinylcarboxylic acid amides, such as N-vinylformamide, N-vinyl-N-methylformamide, N-vinylacetamide, N-vinyl-N-methylacetamide, N-vinyl-N-ethylformamide, N-vinyl-N-n-propylformamide, N-vinyl-N-isopropylformamide, N-vinyl-N-isobutylformamide, N-vinyl-N-methylacetamide, N-vinyl-N-n-butylacetamide and N-vinyl-N-methylpropionamide, preferably of N-vinylformamide, and preferably subsequent complete or in particular partial hydrolysis of the amide functions to amine functions.

The hydrolysis can be carried out under alkaline or acidic conditions, preferably working in an aqueous medium and at a temperature of 70 to 90° C. However, it is also possible to use inert organic solvents, such as dioxane or aliphatic or aromatic hydrocarbons, or alcohols, for example tert-butanol, as the reaction medium.

The polymers to be used according to the invention can additionally contain a monoethylenically unsaturated comonomer polymerized therein. Of course, a plurality of comonomers can also be polymerized in the polymer. Suitable comonomers are anionic, non-ionic and cationic monomers.

Examples of suitable anionic comonomers are:

- α,β-unsaturated monocarboxylic acids which preferably have 3 to 6 carbon atoms, such as acrylic acid, methacrylic acid, ethacrylic acid, crotonic acid and vinylacetic acid, and the alkali metal and ammonium salts thereof;
- unsaturated dicarboxylic acids which preferably have 4 to 6 carbon atoms, such as itaconic acid and maleic acid, the anhydrides thereof, such as maleic anhydride, and the alkali metal and ammonium salts thereof;
- half-esters of unsaturated dicarboxylic acids with C1-C6 alcohols, such as itaconic and maleic acid half-esters.

Acrylic acid and the salts thereof, especially sodium acrylate, are preferred as the anionic comonomers.

Suitable non-ionic comonomers are, for example:

- esters of monoethylenically unsaturated C3-C6 carboxylic acids, especially of acrylic acid and methacrylic acid, with monovalent C1-C22 alcohols, in particular with C1-C6 alcohols; and hydroxyalkyl esters of monoethylenically unsaturated C3-C6 carboxylic acids, especially of acrylic acid and methacrylic acid, with bivalent C2-C4 alcohols, such as methyl (meth)acrylate, ethyl (meth)acrylate, n-butyl (meth)acrylate, sec-butyl (meth)acrylate, tert-butyl (meth)acrylate, ethylhexyl (meth)acrylate, hydroxyethyl (meth)acrylate and hydroxypropyl (meth)acrylate;
- amides of monoethylenically unsaturated C3-C6 carboxylic acids, especially of acrylic acid and methacrylic acid, with primary and secondary C1-C12 amines, such as (meth)acrylamide, N-methyl (meth)acrylamide, N-isopropyl (meth)acrylamide and N-butyl (meth) acrylamide;
- vinyl esters of saturated C1-C11 carboxylic acids, such as vinyl acetate and vinyl propionate;
- aliphatic and aromatic olefins, such as ethylene, propylene, C4-C24 α-olefins, in particular C4-C16 α-olefins, for example butylene, isobutylene, diisobutene, styrene and α-methylstyrene, and also diolefins having an active double bond, for example butadiene; unsaturated alcohols, such as vinyl alcohol and allyl alcohol;
- unsaturated nitriles, such as acrylonitrile and methacrylonitrile.

Examples of suitable cationic comonomers are:

- N-vinyl lactams of lactams having 5- to 7-membered rings, such as N-vinylpyrrolidone, N-vinylcaprolactam and N-vinyl oxazolidone;
- monomers which contain vinylimidazole and vinylimidazoline units, and the alkyl derivatives thereof, in particular C1-C15 alkyl derivatives, and the quaternization products thereof, such as N-vinylimidazole, N-vinyl-2-methylimidazole, N-vinyl-4-methylimidazole, N-vinyl-5-methylimidazole, N-vinyl-2-ethylimidazole, N-vinylimidazoline, N-vinyl-2-methylimidazoline and N-vinyl-2-ethylimidazoline;

vinylpyridines and the quaternization products thereof, such as 4-vinylpyridine, 2-vinylpyridine, N-methyl-4-vinylpyridine and N-methyl-2-vinylpyridine;

basic esters of ethylenically unsaturated carboxylic acids, in particular the esters of α,β-unsaturated C3-C6 monocarboxylic acids, especially of acrylic acid and methacrylic acid, with amino alcohols, especially N,N-di(C1-C4 alkyl)amino-C2-C6 alcohols, and the quaternization products thereof, such as dimethylaminoethyl (meth)acrylate, dimethylaminopropyl (meth)acrylate, diethylaminoethyl acrylate, diethylaminopropyl acrylate, dimethylaminobutyl acrylate and diethylaminobutyl acrylate;

basic amides of ethylenically unsaturated carboxylic acids, in particular the N,N-di(C1-C4 alkyl)amino(C2-C6 alkyl) amides of α,β-unsaturated C3-C6 monocarboxylic acids, especially of acrylic acid and methacrylic acid, and the quaternization products thereof, such as dimethylaminoethyl (meth)acrylamide, diethylaminoethyl (meth)acrylamide, dimethylaminopropyl (meth)acrylamide and diethylaminopropyl (meth)acrylamide.

If the polymers to be used according to the invention contain comonomers polymerized therein, the content thereof is generally 0.1 to 80 mol. %, in particular up to 50 mol. %, based on the polymer.

The polymers to be used according to the invention can be present in water-soluble form, but they can also be crosslinked and thus water-insoluble. The polymers are preferably water-soluble polymers.

The crosslinking can be carried out by means of thermal treatment of the polymer and/or by means of reaction with formic acid derivatives, with amidines specifically being formed. However, the crosslinking is preferably carried out by means of polymerizing a further crosslinking comonomer which contains at least two ethylenically unsaturated, nonconjugated double bonds.

Suitable crosslinking agents are, for example:

alkylene bisacrylamides such as methylene bisacrylamide and N,N'-acryloyl ethylenediamine;

divinylalkylene ureas such as N,N'-divinylethylene urea and N,N'-divinylpropylene urea;

ethylidenebis-3-(N-vinylpyrrolidone), N,N'-divinyldiimidazolyl(2,2')butane, and 1,1'-bis(3,3-vinylbenzimidazolith-2-one)1,4-butane;

alkylene glycol di(meth)acrylates such as ethylene glycol di(meth)acrylate, diethylene glycol di(meth)acrylate and tetraethylene glycol di(meth)acrylate;

aromatic divinyl compounds such as divinylbenzene and divinyltoluene; vinyl acrylate, allyl (meth)acrylate, triallylamine, divinyldioxane and pentaerythritol triallyl ether.

The polymers according to the invention preferably have weight-average molecular weights Mw of from 1,000 to 6,000,000 g/mol, preferably from 45,000 to 450,000 g/mol.

A copolymer of vinylamine and N-vinylformamide is particularly preferred. Since vinylamine itself is not accessible, copolymers of vinylamine and N-vinylformamide are prepared by means of polymerization of N-vinylformamide and subsequent alkaline hydrolysis as described above. In so doing, products which have different degrees of hydrolysis can be prepared. Copolymers of vinylamine and N-vinylformamide are commercially available under the name "Lupamin®" from BASF, for example.

In various embodiments of the invention, the gels are characterized in that the at least one glass protection additive is selected from zinc chloride, zinc acetate, zinc ricinoleate, polyvinylamine, polyvinylamide and mixtures thereof, preferably polyvinylamine and at least one zinc salt selected from zinc chloride, zinc acetate and zinc ricinoleate being contained.

In preferred embodiments, the at least one zinc salt, in particular zinc chloride, zinc acetate or zinc ricinoleate, is contained in 0.5 to 15.0 wt. %, preferably 2 to 10 wt. %, based on the total weight of the gel; and/or the polyvinylamine is contained in 0.1 to 10 wt. %, preferably 1 to 5 wt. %, based on the total weight of the gel.

The gel can also contain at least one solvent. The at least one solvent is preferably an organic solvent, in particular a mixture of a polar and a non-polar solvent. The polar solvent is particularly preferably an organic solvent having at least one hydroxy group, in particular alkanolamines, polyols such as ethylene glycol, 1,2-propylene glycol and 1,2-glycerol, in particular 1,2-propylene glycol. The at least one non-polar organic solvent is preferably an oil, in particular a naturally occurring vegetable oil such as castor oil, coconut oil, corn oil, linseed oil, cottonseed oil, sesame oil, palm oil, olive oil, sunflower oil or soybean oil, in particular castor oil.

In various embodiments, the at least one solvent is contained in amounts of 20.0 to 90.0 wt. %, preferably 50.0 to 85 wt. %, particularly preferably in 70.0 to 80.0 wt. %, in each case based on the total weight of the gel.

The gel can also contain at least one additive. The additives are preferably selected from alkali and alkaline-earth metal salts, such as sodium sulfate, fillers, such as silica or Aerosil, corrosion inhibitors, enzymes, builders, such as Aerosil, foam inhibitors, surfactants, bitterns, sequestering agents, electrolytes, fragrances, antimicrobial active ingredients and dyes.

In various embodiments, the at least one additive is contained in an amount of 0.1 to 40 wt. %, preferably 5 to 30 wt. %, more preferably 15 to 25 wt. %, in each case based on the total weight of the gel.

In preferred embodiments, the gel is substantially phosphate-free and/or phosphonate-free.

In further preferred embodiments, the gel is free of bleaching agent. Substantially "phosphate-free" and "phosphonate-free," as used herein, means that the gel in question is substantially free of phosphates or phosphonates, i.e. contains in particular phosphates or phosphonates in amounts of less than 0.1 wt. %, preferably less than 0.01 wt. %, based on the total weight of the gel.

Usable builders include aminocarboxylic acids and their salts, carbonates, organic cobuilders and silicates.

Aminocarboxylic acids and/or the salts thereof represent another important class of builders. Particularly preferred representatives of this class are methylglycinediacetic acid (MGDA) or the salts thereof, and glutamic diacetic acid (GLDA) or the salts thereof or ethylenediaminediacetic acid or the salts thereof (EDDS). Iminodisuccinic acid (IDS) and iminodiacetic acid (IDA) are also suitable. The content of these aminocarboxylic acids or the salts thereof can, for example, be between 0.1 and 15 wt. %, preferably between 0.5 and 10.0 wt. %, and in particular between 0.5 and 6 wt. %. Aminocarboxylic acids and the salts thereof can be used together with the aforementioned builders, in particular also with the phosphate-free builders.

Polycarboxylates/polycarboxylic acids, polymeric carboxylates, aspartic acid, polyacetals and dextrins are particularly noteworthy as organic cobuilders.

Suitable organic builders are the polycarboxylic acids that can be used in the form of the free acids and/or the sodium salts thereof, for example, with polycarboxylic acids being understood to mean those carboxylic acids which carry more than one acid function. These include, for example, citric acid, adipic acid, succinic acid, glutaric acid, malic acid, tartaric acid, maleic acid, fumaric acid, saccharic acids, aminocarboxylic acids, nitrilotriacetic acid (NTA), provided that the use of NTA is not objectionable for ecological reasons, and mixtures thereof.

It is also possible, for example, to use carbonate(s) and/or hydrogen carbonate(s), preferably alkali carbonate(s), particularly preferably sodium carbonate. Alkali carbonates, in particular sodium carbonate, can also be used as pH adjusters, and in various embodiments of the invention are preferably contained in an amount of 15 to 40 wt. %, more preferably 20 to 30 wt. %, based on the gel.

Polymeric polycarboxylates are also suitable as builders. These are, for example, the alkali metal salts of polyacrylic acid or polymethacrylic acid, for example those having a weight-average molecular weight of 500 to 70,000 g/mol.

Suitable polymers are in particular polyacrylates which preferably have a weight-average molecular weight of 2,000 to 20,000 g/mol. Due to their superior solubility, the short-chain polyacrylates which have a weight-average molecular weight of 2,000 to 10,000 g/mol, and particularly preferably 3,000 to 5,000 g/mol, can be preferred from this group.

The gels can also contain, as a builder, crystalline layered silicates of general formula $NaMSi_xO_{2x+1}$*y $H_2O$, where M represents sodium or hydrogen, x is a number from 1.9 to 22, preferably from 1.9 to 4, with 2, 3 or 4 being particularly preferred values for x, and y represents a number from 0 to 33, preferably from 0 to 20. Amorphous sodium silicates with an $Na_2O:SiO_2$ modulus of 1:2 to 1:3.3, preferably 1:2 to 1:2.8, and in particular 1:2 to 1:2.6, can also be used which preferably exhibit retarded dissolution and secondary washing properties.

In preferred gels, the silicate content is limited to amounts below 10 wt. %, preferably below 5 wt. %, and in particular below 2 wt. %. Particularly preferred gels are silicate-free.

Individual odorant compounds, such as the synthetic products of the ester, ether, aldehyde, ketone, alcohol, and hydrocarbon types, can be used as perfume oils or fragrances within the scope of the present invention. However, mixtures of different odorants are preferably used which together produce an appealing fragrance note. Perfume oils of this kind can also contain natural odorant mixtures, as are obtainable from plant sources, e.g. pine, citrus, jasmine, patchouli, rose or ylang-ylang oil. The fragrances/perfume oils can be encapsulated, for example in microcapsules, or used in free form or both.

During use, the gel according to the invention can be introduced directly into the washing compartment or the dishwasher. For example, the metering can take place via a metering chamber of an automatic dishwasher. In so doing, the addition can be done at any time in the washing program.

The gel according to the invention can be present in pre-portioned form as a single-use portion, in particular in the form of a water-soluble pouch, preferably having a polyvinyl alcohol-based casing, usually in the form of a water-soluble PVA film.

All of the (preferred) embodiments described herein in connection with the gels according to the invention can also be used for the use according to the invention and corresponding methods, and vice versa.

EXAMPLES

Gels were prepared from the following compositions:

| Ingredient | Ex. 1 wt. % | Ex. 2 wt. % | Ex. 3 wt. % | Ex. 4 wt. % | Ex. 5 wt. % |
|---|---|---|---|---|---|
| 1,2-propylene glycol | 40.0 | 40.0 | 40.0 | 40.0 | 40.0 |
| Silica (Aerosil 300) | 10.0 | 10.0 | 10.0 | 10.0 | 10.0 |
| Jaguar C-13-S (Solvay) (cationic polysaccharide) | 1 | 1 | 1 | 1 | 1 |
| Sodium sulfate | 8 | 8 | 8 | 8 | 8 |
| Castor oil | 36 | 34 | 35 | 35 | 36 |
| Zinc chloride | — | 7 | 3 | — | — |
| Zinc acetate | — | — | 3 | 4 | — |
| Zinc ricinoleate | — | — | — | — | 5 |
| Lupamin 1595 (polyvinylamine) | 5 | — | — | 2 | — |

What is claimed is:

1. A gel suitable for the corrosion protection of glassware comprising of at least one polysaccharide polymer;

at least one glass protection additive selected from zinc salts, polyvinylamine, polyvinylamide or mixtures thereof;

optionally at least one solvent; and optionally at least one additive; wherein the at least one polysaccharide polymer is a cationic polysaccharide polymer.

2. The gel according to claim 1, wherein (a) the at least one polysaccharide polymer is contained in 0.1 wt. % to 3 wt. % based on the total weight of the gel; and/or (b) the at least one glass protection additive is contained in 0.1 to 15.0 wt. % based on the total weight of the gel.

3. The gel according to claim 1, wherein the at least one glass protection additive is selected from zinc chloride, zinc acetate, zinc ricinoleate, polyvinylamine, polyvinylamide and mixtures thereof being contained.

4. The gel according to claim 1, wherein the at least one zinc salt is contained in 0.5 to 15.0 wt. % based on the total weight of the gel, and/or in that the polyvinylamine is contained in 0.1 to 10 wt. % based on the total weight of the gel.

5. The gel according to claim 1, wherein (a) the at least one solvent is an organic solvent; and/or (b) the at least one solvent is contained in 20.0 to 90.0 wt. % based on the total weight of the gel.

6. The gel according to claim 1, wherein the gel further contains at least one additive selected from alkali and alkaline-earth metal salts.

7. The gel according to claim 1, wherein the at least one additive is contained in an amount of 0.1 to 40 wt. % in each case based on the total weight of the gel.

8. A method for inhibiting the corrosion of glassware, comprising the steps of:

i) bringing the glassware into contact with the gel according to claim 1, wherein the gel has been dissolved in water;

ii) optionally carrying out a cleaning or rinsing step.

9. The gel according to claim 1, wherein the at least one polysaccharide polymer is selected from the group of cationic cellulose polymers and/or cationic guar derivatives.

10. The gel according to claim 2, wherein (a) the at least one polysaccharide polymer is contained in 0.2 wt. % to 1.5 wt. % based on the total weight of the gel; and/or (b) the at least one glass protection additive is contained in 2.0 to 10.0 wt. % based on the total weight of the gel.

11. The gel according to claim 3, wherein the at least one glass protection additive is polyvinylamine and at least one zinc salt selected from zinc chloride, zinc acetate and zinc ricinoleate being contained.

12. The gel according to claim 4, wherein zinc chloride, zinc acetate or zinc ricinoleate is contained in 2 to 10 wt. % based on the total weight of the gel, and/or in that the polyvinylamine is contained in 1 to 5 wt. % based on the total weight of the gel.

13. The gel according to claim 5, wherein the at least one solvent is a mixture of a polar and a non-polar solvent.

14. The gel according to claim 5, wherein the at least one solvent is an organic solvent having at least one hydroxy group being contained and/or a non-polar organic solvent.

15. The gel according to claim 5, wherein the at least one organic solvent is contained in 50.0 to 85 wt. % based on the total weight of the gel.

16. The gel according to claim 5, wherein the at least one organic solvent is contained in 70.0 to 80.0 wt. % based on the total weight of the gel.

17. The gel according to claim 6, wherein the gel further contains at least one additive selected from sodium sulfate, fillers, builders, corrosion inhibitors, enzymes, foam inhibitors, surfactants, bitterns, sequestering agents, electrolytes, fragrances, antimicrobial active ingredients and dyes.

18. The gel according to claim 7, wherein the at least one additive is contained in an amount of 5 to 30 wt. % in each case based on the total weight of the gel.

19. The gel according to claim 7, wherein the at least one additive is contained in an amount of 15 to 25 wt. % in each case based on the total weight of the gel.

20. The gel according to claim 1, further comprising of at least one solvent.

* * * * *